US011307514B2

(12) United States Patent
Fort Filgueira et al.

(10) Patent No.: US 11,307,514 B2
(45) Date of Patent: Apr. 19, 2022

(54) RESOURCE CONDITIONING

(71) Applicant: Hewlett-Packard Development Company, L.P., Spring, TX (US)

(72) Inventors: Aleix Fort Filgueira, Sant Cugat del Valles (ES); Alejandro Mielgo, Sant Cugat del Valles (ES); Michel Georges Encrenaz, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/050,468

(22) PCT Filed: Jun. 15, 2018

(86) PCT No.: PCT/US2018/037733

§ 371 (c)(1),
(2) Date: Oct. 26, 2020

(87) PCT Pub. No.: WO2019/240812

PCT Pub. Date: Dec. 19, 2019

(65) Prior Publication Data

US 2021/0103232 A1 Apr. 8, 2021

(51) Int. Cl.

| | |
|---|---|
| ***G03G 15/08*** | (2006.01) |
| ***G03G 15/00*** | (2006.01) |
| ***G03G 21/16*** | (2006.01) |

(52) U.S. Cl.

CPC ..... *G03G 15/0863* (2013.01); *G03G 15/55* (2013.01); *G03G 21/1652* (2013.01); *G03G 21/1657* (2013.01); *G03G 2221/1823* (2013.01)

(58) Field of Classification Search

CPC ..... G03G 15/0863; G03G 15/55; G03G 21/1652; G03G 21/1657; G03G 2221/1823

See application file for complete search history.

(56) References Cited

U.S. PATENT DOCUMENTS

| | | | |
|---|---|---|---|
| 7,346,285 | B2 | 3/2008 | Nagahama et al. |
| 8,537,014 | B2 | 9/2013 | Broer |
| 9,389,567 | B2 | 7/2016 | Kobayashi |
| 2007/0222615 | A1 | 9/2007 | Yamaguchi |

(Continued)

FOREIGN PATENT DOCUMENTS

| | | | |
|---|---|---|---|
| EP | 2495620 | A1 | 9/2012 |
| JP | 2003271021 | A | 9/2003 |

(Continued)

OTHER PUBLICATIONS

Gupta, Gaurangi et al., Orientation Detection Using Passive UHF RFID Technology, Dec. 2014, IEEE.

(Continued)

*Primary Examiner* — Joseph S Wong

(74) *Attorney, Agent, or Firm* — HP Inc. Patent Department

(57) ABSTRACT

There is provided a method and apparatus for monitoring conditioning of a rendering material in a storage structure, where the storage structure comprises a passive transceiver. The passive transceiver may generate a varying response signal where a strength of the varying signal can be monitored and used to determine a pre-conditioning parameter indicative of a condition of the storage structure.

14 Claims, 7 Drawing Sheets

(56) References Cited

U.S. PATENT DOCUMENTS

| | | | | |
|---|---|---|---|---|
| 2011/0085709 | A1* | 4/2011 | Watanabe | G03G 21/1657 382/115 |
| 2014/0375709 | A1 | 12/2014 | Kagata | |

FOREIGN PATENT DOCUMENTS

| | | | |
|---|---|---|---|
| JP | 4329671 | B2 | 9/2009 |
| JP | 2012096502 | | 5/2012 |

OTHER PUBLICATIONS

Ziai, M.A et al., Tilt and Tamper Sensing UHF RFID Security Tag, Nov. 2017, KAR.

* cited by examiner

RESOURCE CONDITIONING

BACKGROUND

The disclosure relates to monitoring a condition of a rendering material in a storage structure for maintaining image quality in a rendering apparatus.

BRIEF DESCRIPTION OF THE DRAWINGS

Various features and advantages of certain examples will be apparent from the detailed description which follows, taken in conjunction with the accompanying drawings, which together illustrate, by way of example only, a number of features, and wherein.

DETAILED DESCRIPTION

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Printing systems can render an image on a print target using a printing fluid resource. A printing fluid may comprise a formulation of pigments suspended in a liquid vehicle, where the formulation may vary widely between printing technologies and/or between colors. Printing fluids may comprise non-marking fluids, for example an optimizer fluid. The printing fluid may be provided in a storage structure such as a printing cartridge. The storage structure comprises the printing fluid resource. When the printing fluid remains at rest for an extended period of time, for example a few days, components of the formulation may settle. A user may be instructed to pre-condition a printing fluid before the printing system uses it to render an image. For example, a user may be instructed to shake a printing fluid or print cartridge before inserting it into the printing system. The user may be instructed to shake the printing fluid in a particular manner. There is disclosed a system and method for monitoring a condition of a printing fluid. The user may follow a conditioning procedure in such a manner as to provide maximum reliability and image quality.

There is disclosed a method in which a printing system can determine whether the user has conditioned the printing fluid resource before inserting the supply into the printing system. The method allows determination of whether the printing fluid resource has recently been shaken and/or if the conditioning process is adequate. For example, parameters such as the duration, direction and speed at which the user shakes the printing fluid resource or cartridge can be determined. These parameters may depend upon the printing fluid formulation and/or physical dimensions of a cartridge supply, such as the cartridge shape and/or size.

Figure 1A:
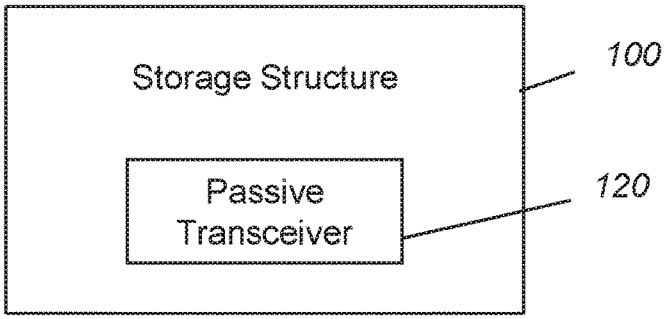
FIG. 1A is a schematic of a storage structure according to an example.

FIG. 1A is a schematic of a storage structure according to an example. The storage structure may be a print cartridge for a printing apparatus or rendering apparatus. The storage structure 100 comprises a passive transceiver 110 configured to generate a response signal when energised. For example, the passive transceiver may reply or respond to an interrogation signal from an external or second transceiver which may be located at the printing system. According to an example, the passive transceiver is an RFD tag with an embedded antenna and identification number. According to an example, the storage structure may comprise a transmitter and/or receiver instead of a transceiver.

Figure 1B:
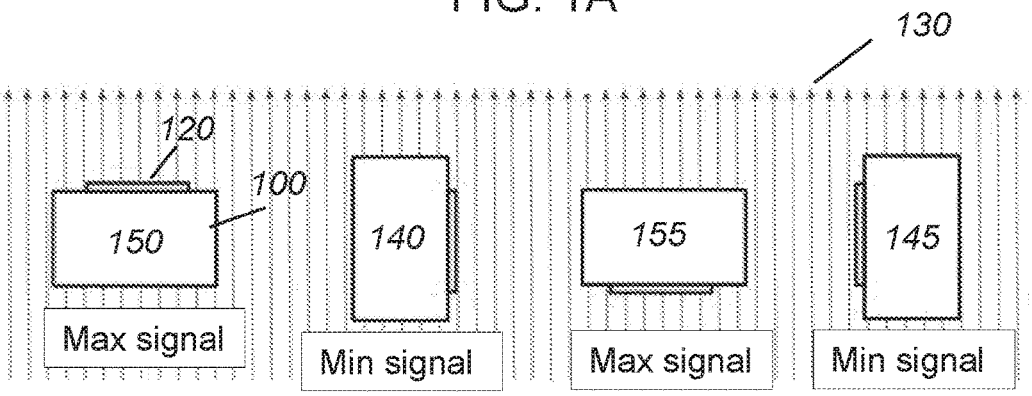
FIG. 1B is a schematic showing a storage structure and passive transceiver in an electromagnetic field according to an example.

FIG. 1B is a schematic showing a storage structure 100 and passive transceiver 120 in an electromagnetic field 130 according to an example. The electromagnetic field may be generated by a reader or component provided on a printing apparatus proximate to or within range of the storage structure and transceiver. According to an example, an RFID tag on the storage structure has an embedded antenna. The antenna is configured to provide a maximum response signal when the antenna is perpendicular 140, 145 to the electromagnetic field and a minimum response signal when the antenna is parallel 150, 155 to the electromagnetic field. A directional component can be determined from the response signal indicating the direction in which the antenna is facing with respect to the electromagnetic field.

According to an example, information stored on the RFID tag may contain an identification code. The identification code may be consistent with a security chip of the storage structure which the printing apparatus can read in order to identify the resource which the user can insert. As the user conditions the resource, for example by shaking or agitating the printing fluid formulation, the storage structure and antenna/transceiver rotate throughout the electromagnetic field. The strength of the signal detected varies according to the movement of the transceiver through the electromagnetic field.

Figure 2:
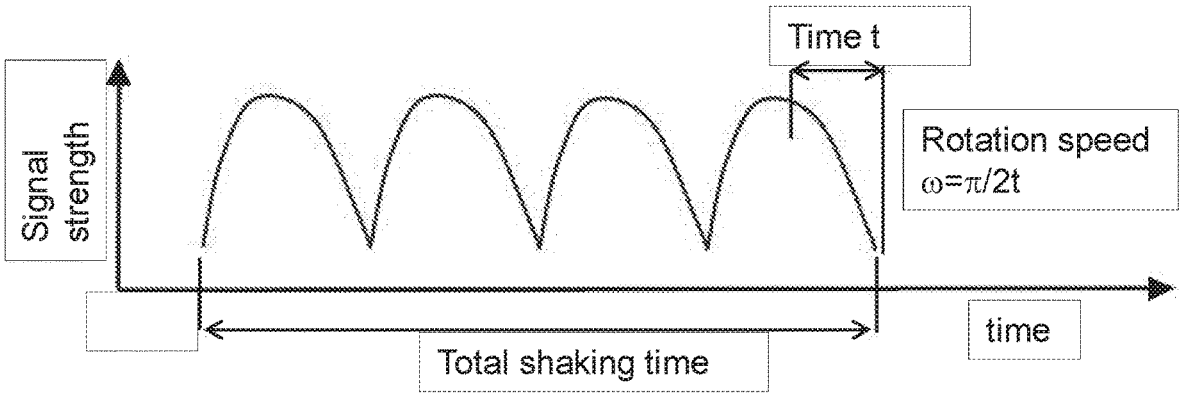
FIG. 2 is a schematic of a response signal from a transceiver according to an example.

FIG. 2 is a schematic of a response signal from a transceiver according to an example. The strength of the signal can vary over time as the storage structure is moved through the electromagnetic field by the user. The response signal may be cyclical with a series of peaks and troughs. Temporal processing of the response signal provides information about the direction of rotation, speed of rotation and the duration of movement through the electromagnetic field. These parameters can be determined by analysing the change in signal strength over time.

According to an example, a response signal from a first communication device on a storage structure is detected by a second communication device which is remote to the storage structure. For example, the response signal from a passive transceiver on a print cartridge may be detected by an active transceiver on a printing apparatus. As the storage structure is rotated or moved through the electromagnetic field by the user the strength of the response signal changes as the orientation of the antenna to the direction of the electromagnetic field changes. For example, the response signal may be maximised when the antenna is substantially perpendicular to the electromagnetic field and minimised when the antenna is substantially parallel to the electromagnetic field.

Figure 3:
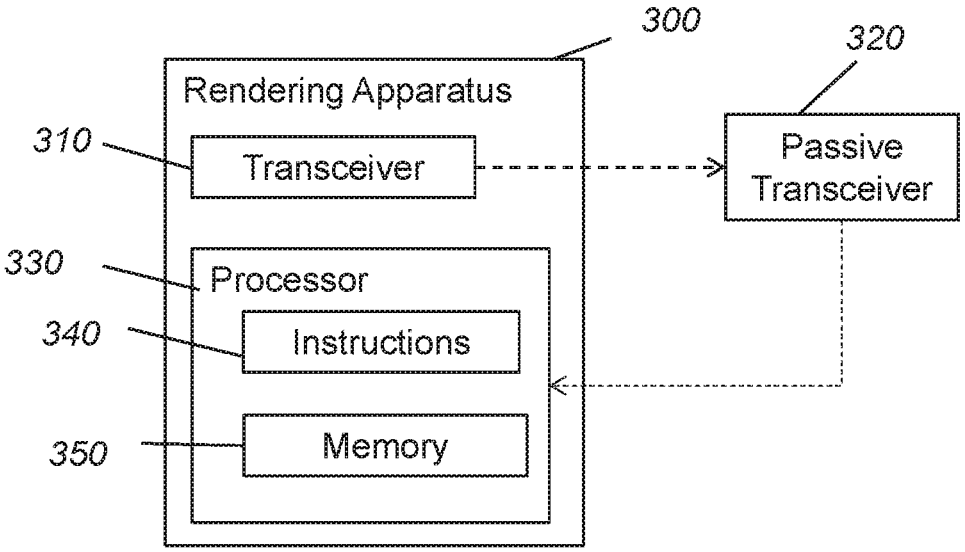
FIG. 3 showing a system for monitoring conditioning of a rendering material in a storage structure according to an example.

FIG. 3 is a schematic showing a system for monitoring conditioning of a rendering material in a storage structure according to an example. A rendering apparatus 300 may comprise an active transceiver 310 configured to energise a remote passive transceiver 320. For example, the rendering apparatus may be configured to generate an electromagnetic field which can generate a response signal from the passive transceiver. The response signal from the remote transceiver can be detected by the transceiver in the rendering apparatus and processed by a processor 330. The processor may comprise instructions 340 and a memory 350. As the storage structure and antenna rotate through the electromagnetic field the response signal varies. The processor is configured to monitor variations in the strength of the response signal. The response signal may be stored in the memory, for example for analysing or comparison to pre-determined response signals. The processor can use the strength of the response signal to generate respective measures for a speed of rotation of the passive transceiver and/or a number of rotations of the passive transceiver through the electromagnetic field. The processor may analyse the response signal to determine a period of time in which the speed of rotation of the passive transceiver exceeds a pre-determined speed threshold. The processor may analyse the response signal to determine a period of time in which the number of rotations exceed a pre-determined threshold number of rotations. The respective threshold values provide an indication of whether or not the user has adequately shaken or conditioned the storage structure.

According to an example, an RFID reader is located at the printing apparatus and a passive RFID tag is located in one or more storage structures. Each storage structure may correspond to a supply of printing fluid. The passive RFD tag may comprise identification information, such as an ID code or security chip, to identify the storage structure to which it relates. The RFD reader at the printing apparatus can read or detect this identification information to identify the storage structure and rendering fluid supply. For example, the identification information may comprise details of the rendering fluid supply such as the type of rendering fluid or pigment type.

According to an example, there is provided a rendering apparatus configured to determine a level of mixing of a printing fluid in a printing cartridge. At an initial time when the user wishes to load a new printing cartridge into the rendering apparatus, the user may condition the rendering fluid by shaking the printing cartridge. A first communication device on the rendering apparatus can generate an electromagnetic field. When the user physically moves the printing cartridge with the second communication device in the electromagnetic field a response signal is generated from the printing cartridge. The user may shake and/or rotate the printing cartridge in close proximity to the rendering apparatus such that the second communication device experiences and responds to the electromagnetic field. The first communication device senses and reads the signal from the second communication device on the printing cartridge. If certain parameters of the signal are determined to reach a particular threshold level, then, it is determined that the user has adequately conditioned the rendering fluid, i.e. an adequate level of mixing has been reached. Otherwise, it may be determined that adequate conditioning has not been performed. The user may be informed of the determination of whether or not adequate conditioning has been performed and/or whether or not a threshold has been met. For example, the user may be informed if more mixing of the rendering fluid is desired.

According to an example, a further tag may be provided on the storage structure and/or rendering apparatus for improved condition tracking performance. For example, a real-time user interface may be provided to prompt or indicate to the user if they are shaking the storage structure incorrectly, i.e. too fast, too slow, not long enough amount of time or rotations.

Figure 4A:
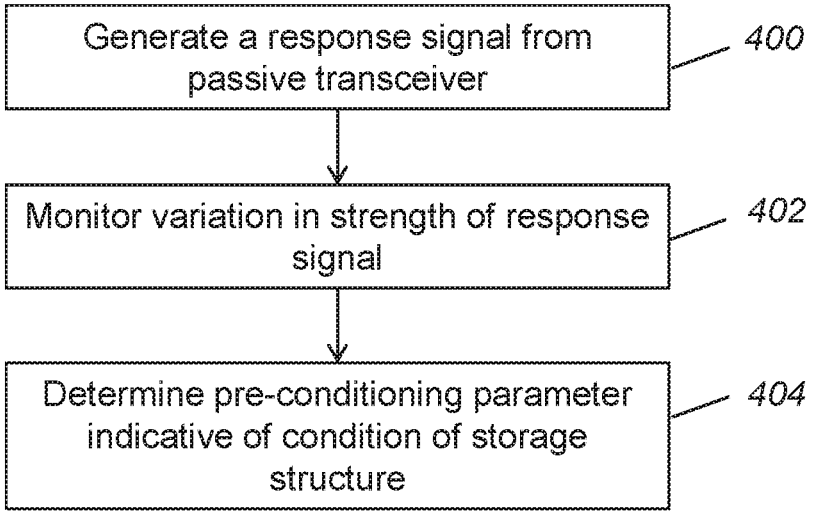
FIGS. 4A-E show a method for monitoring conditioning of a rendering material in a storage structure according to an example.

FIG. 4A shows a method for monitoring conditioning of a rendering material in a storage structure according to an example. The storage structure comprises a passive transceiver. At block 400 the passive transceiver may generate a response signal. The signal may be responsive to an activating field such as an electromagnetic field generated by a communication device remote from the passive transceiver. The response signal may be obtained from the passive transceiver at the second communication device or active transceiver located at the printing apparatus. The second communication device may energise the passive transceiver. At block 402 a variation in a strength of the response signal is sensed or monitored by the communication device at the printing apparatus. The response signal may be recorded or stored in a memory. At block 404 the strength of the response signal is used to determine a pre-conditioning parameter indicative of a condition of the storage structure.

According to an example, the pre-conditioning parameter relates to a speed of rotation of the storage structure and/or a number of rotations of the storage structure. The response signal may be analysed and the strength of the response signal used to generate respective measures for the speed of rotation of the storage structure and/or the number of rotations of the storage structure through the electromagnetic field. According to an example, a period of time that the speed of rotation of the storage structure and/or number of rotations exceed a respective predetermined threshold values may be determined. A speed threshold value may be predetermined for the speed of rotation. A rotation threshold value may be predetermined for the number of rotations.

Figure 4B:
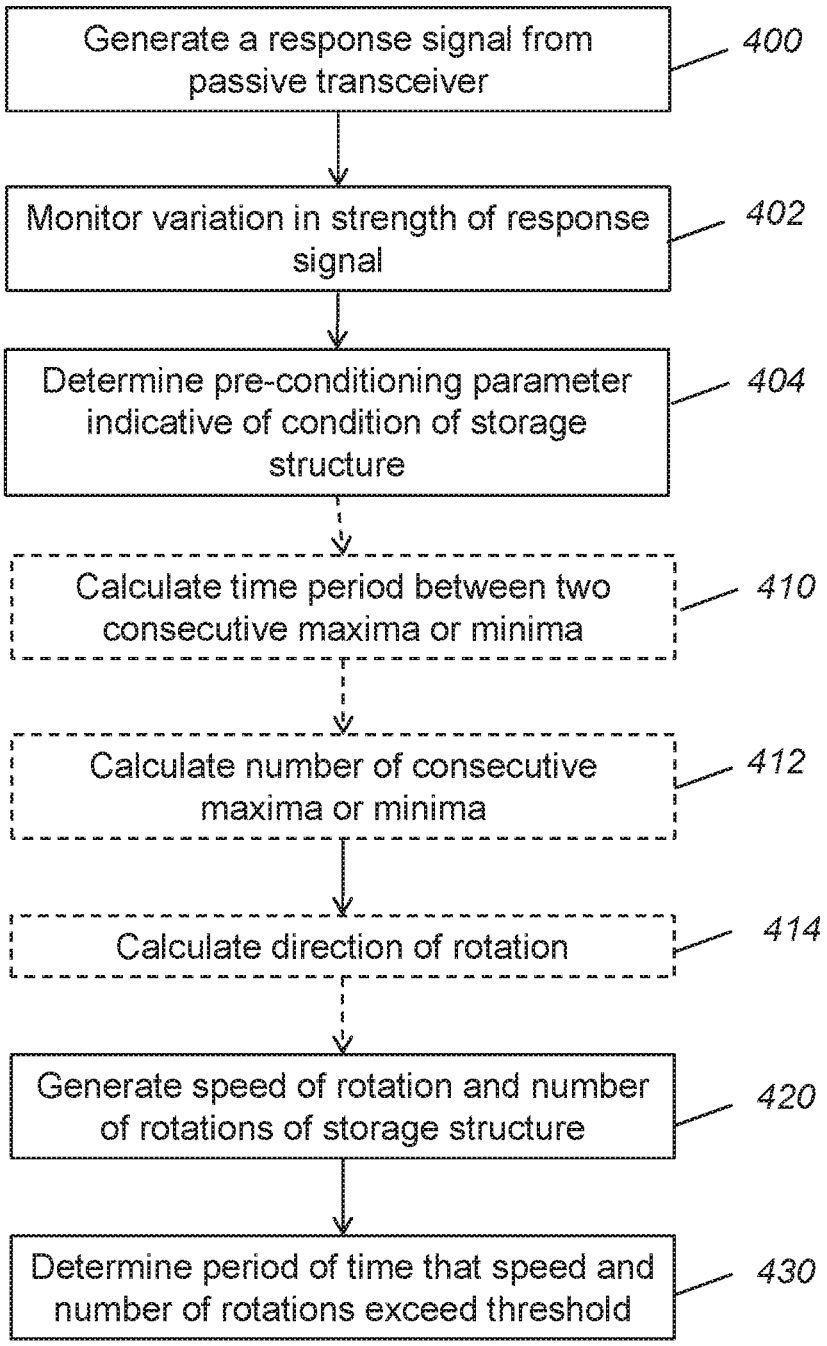

FIG. 4B shows a method for monitoring conditioning of a rendering material in a storage structure according to an example. At block 410 the method may comprise calculating a time period between two consecutive maxima or minima in the strength of the response signal. At block 412 the method may comprise calculating a number of consecutive maxima or minima in the strength of the response signal. At block 414 the method may comprise calculating a direction of rotation based on the response signal. The speed of rotation and number of rotations of the storage structure through the electromagnetic field may be generated at block 420. The period of time that the speed and number of rotations each exceed the respective predetermined thresholds can be determined at block 430. As such the condition of the rendering fluid can be determined based on the derived speed, rotations and/or direction of rotation, According to an example, the condition of the rendering fluid corresponds to a level of mixing of the rendering fluid in the storage structure or printing cartridge. Determination of the condition of the rendering fluid may comprise an evaluation of a direction of the changing response signal to determine a direction of rotation of the print cartridge.

Figure 4C:
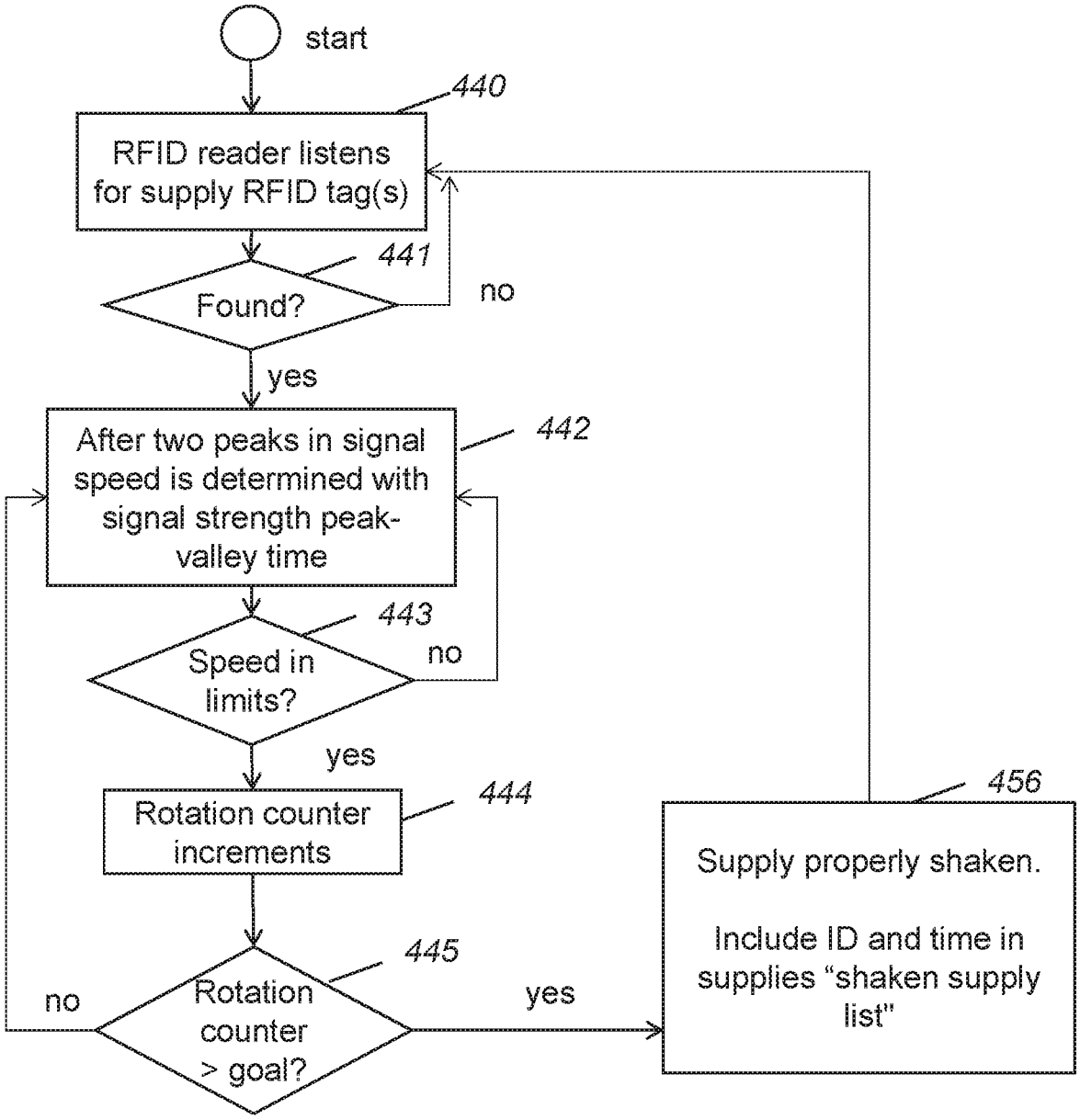

FIG. 4C shows a method for monitoring conditioning of a rendering material in a storage structure according to an example. There is described a condition monitoring algorithm for determining whether a supply has been adequately shaken. If the supply is adequately shaken a serial number of the supply can be stored in a list of adequate supplies. The list of adequate supplies indicates those supplies that can be accepted for the rendering process. For example, once a supply has been shaken, the printing fluid can remain homogenous for a certain amount of time, where afterwards it may be shaken again. The list of supplies may be kept up to date by automatically eliminating a supply from the supply list after a certain amount of time. At block 440 the RFID reader listens for the RFID tag on the supply or storage structure. If the supply RFID tag is located at block 441 the RFID reader monitors the response signal. The response signal may be analysed in real-time and/or stored in memory. For example, if the response signal is stored in memory it may be analysed at a later time. At block 442 the response signal is analysed to locate two peaks in the signal. For example, a consecutive maximum peak and minimum trough or valley. The speed of rotation can be determined using the peak-valley time. At block 443 the speed is evaluated to check if the speed falls within a threshold limit. At block 444 the response signal is analysed to determine a number of consecutive peaks and troughs. The number of rotations is obtained and at block 445 the number of rotations is compared to a threshold value or rotation counter goal. If the number of rotations exceeds the threshold value the supply is determined to be adequately conditioned, i.e. to have been adequately shaken by the user. At block 456 the identification of the storage structure is added to the supply list along with a current timestamp.

Figure 4D:
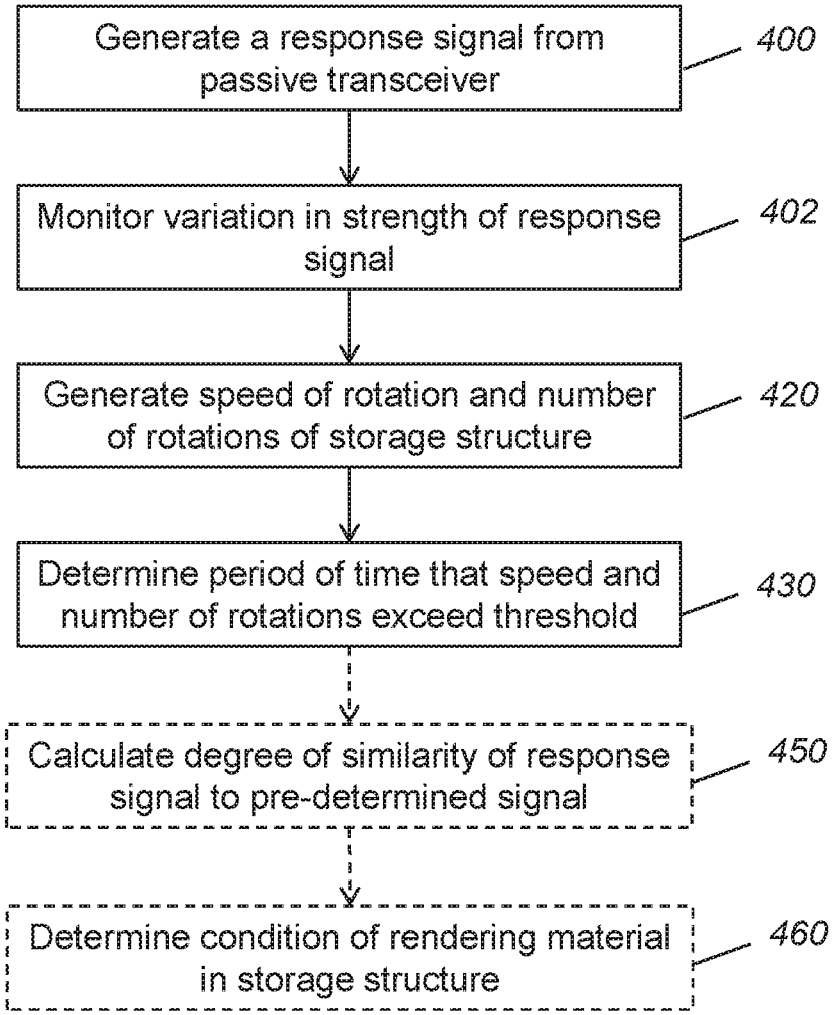

FIG. 4D shows a method for monitoring conditioning of a rendering material in a storage structure according to an example. At block 450 the method may comprise calculating a degree of similarity of the response signal to a pre-determined signal in a set of signals. At block 460 the method may comprise determining, based on the degree of similarity, a condition of the rendering material in the storage structure. As such, a condition of the rendering fluid can be determined based on a comparison of the changing signal to a predetermined set of response signal graphs.

Figure 4E:
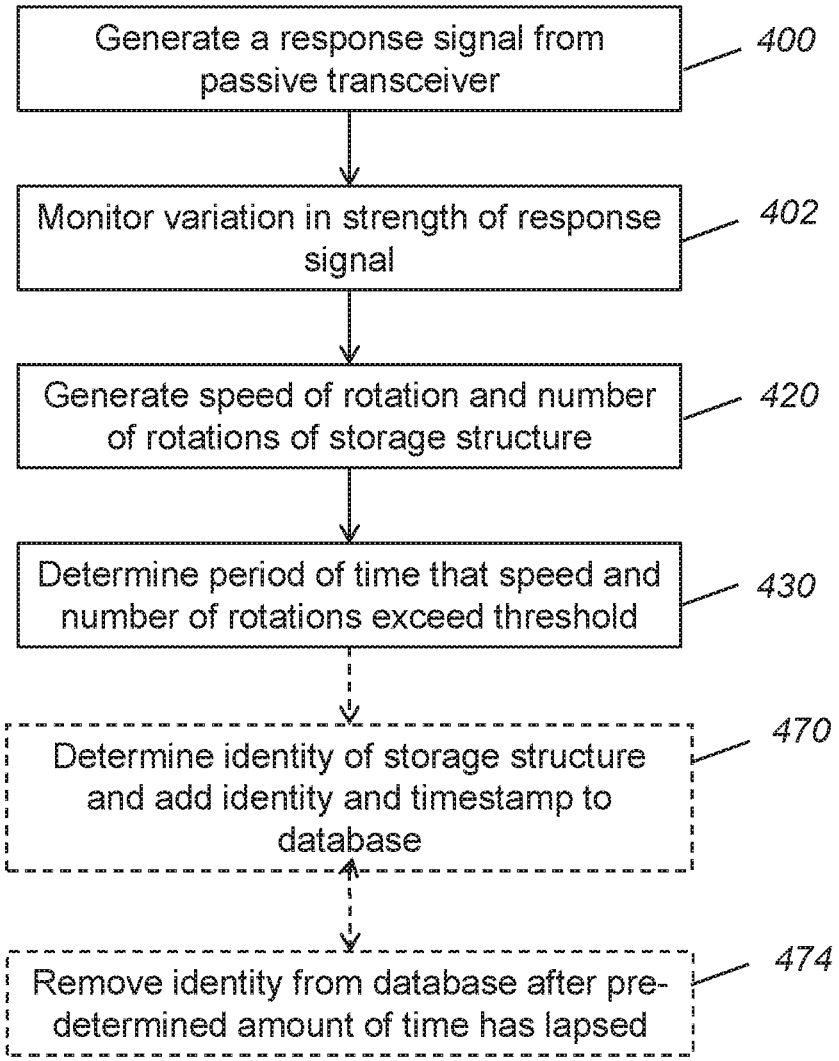

FIG. 4E shows a method for monitoring conditioning of a rendering material in a storage structure according to an example. At block 470 the method may comprise determining an identity of the storage structure via the passive transceiver and adding the identity of the storage structure and a timestamp to a database when a predetermined threshold value is exceeded. At block 474 the method may comprise removing, after a pre-determined amount of time has lapsed beyond the timestamp, the identity of the storage structure from the database. According to an example, the predetermined threshold value corresponds to a formulation of the rendering material or a physical dimension of the storage structure.

Figure 5A:
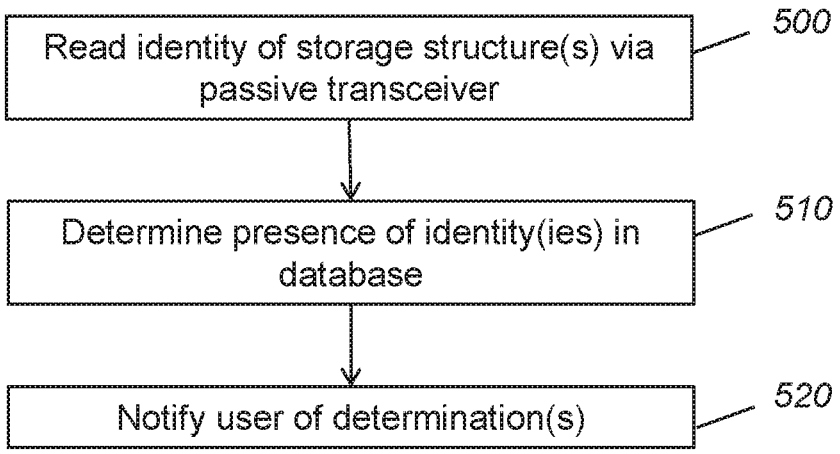
FIGS. 5A and 5B show a method for monitoring conditioning of a rendering material in a storage structure comprising a passive transceiver according to an example.

FIG. 5A shows a method for monitoring conditioning of a rendering material in a storage structure according to an example, where the storage structure comprises a passive transceiver. For example, a user may insert a new supply into the rendering apparatus. The rendering apparatus may check a level of mixing or homogeneity of rendering fluid at the time of the user initially loading or inserting the storage structure or printing cartridge. At block 500 an identity of the storage structure may be read by a communication device interrogating the passive transceiver. At block 510 it can be determined if the identity of the storage structure exists in a pre-determined accepted supply list or database. At block 520 the user may be notified of the determination. The method may further comprise reading an identity of a plurality of storage structures via a respective plurality of passive transceivers, for example at substantially the same time.

Figure 5B:
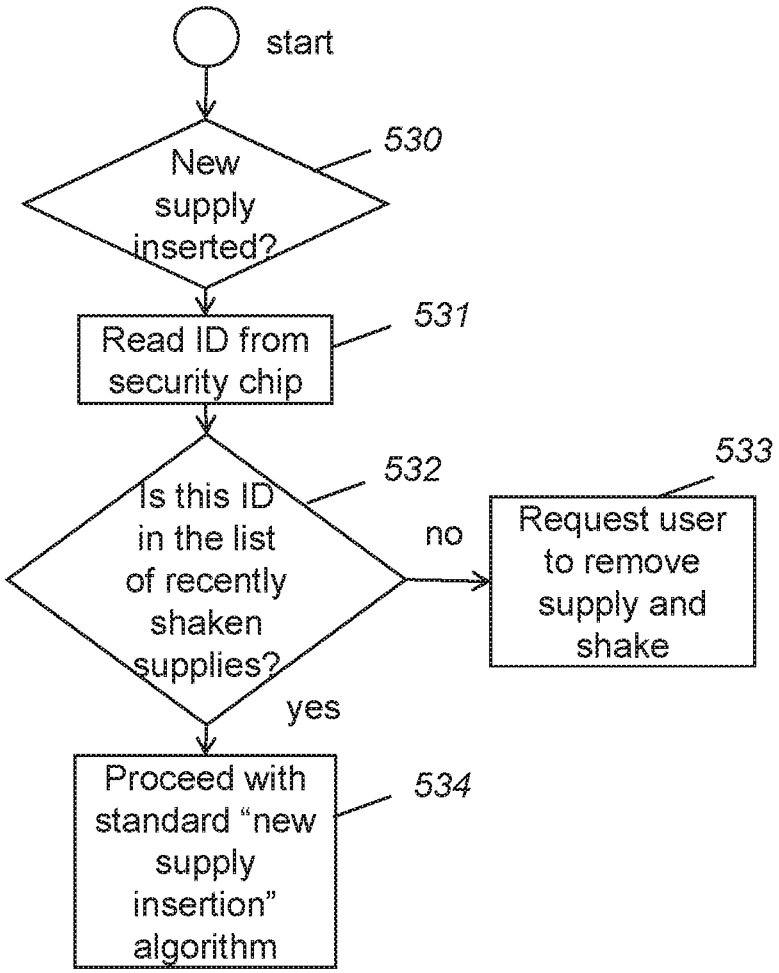

FIG. 5B shows a method for monitoring conditioning of a rendering material in a storage structure according to an example, where the storage structure comprises a passive transceiver. There is described a new supply insertion algorithm. At block 530 the rendering apparatus checks if a new supply has been inserted. At block 531 the rendering apparatus can read an identification, for example on a security chip, on the supply. At block 532 a pre-determined list of acceptable supplies is checked for presence of the identification of the newly loaded supply. The list of acceptable supplies comprises those supplies that have been adequately conditioned. The list of supplies may be updated on an ongoing basis such that the most recently conditioned supplies are maintained in the database. At block 533 if the identification is not found in the database the user may be instructed to remove the supply and condition the rendering fluid by shaking the supply. At block 543 if the identification of the newly loaded supply is found in the database the rendering apparatus may proceed with the rendering process.

The methods, apparatus and systems described herein help to achieve a supply of homogeneous rendering fluid. This improves image quality, particularly for images rendered using white and metallic rendering fluids across several printing technologies, such as Aqueous, Latex, Solvent, UV for example. The monitoring of a condition of a rendering fluid provides a homogenous supply for the rendering process or printing. This consistently improves the image quality, e.g. color output, of the printing device since pigment load changes from drop to drop over time are minimised. Other reliability issues are prevented, for example within the printhead since the pigment load of the rendering fluid is maintained within pre-determined limits or thresholds. As such, the methods described ensure immediate adequate image quality after a supply change, whilst providing for a low-cost solution. The system described provides feedback on whether or not a supply has been adequately conditioned. As such, an auxiliary shaking unit or a printing fluid recirculation system designed to extract rendering fluid from the supply and mix it before inserting it back to the same supply (or being delivered to another rendering fluid tank) may be omitted, reducing costs and providing a more efficient use of resources and time.

Examples in the present disclosure can be provided as methods, systems or machine-readable instructions, such as any combination of software, hardware, firmware or the like. Such machine-readable instructions may be included on a computer readable storage medium (including but not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. In some examples, some blocks of the flow diagrams may not be necessary and/or additional blocks may be added. It shall be understood that each flow and/or block in the flow charts and/or block diagrams, as well as combinations of the flows and/or diagrams in the flow charts and/or block diagrams can be realized by machine readable instructions.

The machine-readable instructions may, for example, be executed by a general-purpose computer, a special purpose computer, an embedded processor or processors of other programmable data processing devices to realize the functions described in the description and diagrams. In particular, a processor or processing apparatus may execute the machine-readable instructions. Thus, modules of apparatus may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate set etc. The methods and modules may all be performed by a single processor or divided amongst several processors.

Such machine-readable instructions may also be stored in a computer readable storage that can guide the computer or other programmable data processing devices to operate in a specific mode.

For example, the instructions may be provided on a non-transitory computer readable storage medium encoded with instructions, executable by a processor.

Such machine-readable instructions may also be loaded onto a computer or other programmable data processing devices, so that the computer or other programmable data processing devices perform a series of operations to produce computer-implemented processing, thus the instructions executed on the computer or other programmable devices provide an operation for realizing functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. In particular, a feature or block from one example may be combined with or substituted by a feature/block of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method for monitoring conditioning of a rendering material in a storage structure, the storage structure including a passive transceiver, the method comprising:

energizing the passive transceiver to generate a response signal;

monitoring variation in a strength of the response signal; and determining, using the strength of the response signal, a pre-conditioning parameter indicative of a condition of the storage structure.

2. The method as claimed in claim 1, wherein the pre-conditioning parameter relates to a speed of rotation of the storage structure.

3. The method as claimed in claim 2, further comprising:

determining a period of time that the speed of rotation of the storage structure exceeds a predetermined speed threshold value.

4. The method as claimed in claim 1, wherein the pre-conditioning parameter relates to a number of rotations of the storage structure.

5. The method as claimed in claim 4, further comprising:

determining a period of time that the number of rotations of the storage structure exceeds a predetermined rotation threshold value.

6. The method as claimed in claim 1, further comprising:

calculating a time period between two consecutive maxima or minima in the strength of the response signal.

7. The method as claimed in claim 1, further comprising:

calculating a number of consecutive maxima or minima in the strength of the response signal.

8. The method as claimed in claim 1, further comprising:

calculating a direction of rotation based on the response signal.

9. The method as claimed in claim 1, further comprising:

calculating a degree of similarity of the response signal to a pre-determined signal in a set of signals.

10. The method as claimed in claim 9, further comprising:

determining, based on the degree of similarity, a condition of the rendering material in the storage structure.

11. The method as claimed in claim 1, further comprising:

determining an identity of the storage structure via the passive transceiver; and adding the identity of the storage structure and a timestamp to a database when a predetermined threshold value is exceeded.

12. The method as claimed in claim 11, further comprising:

removing, after a pre-determined amount of time has lapsed beyond the timestamp, the identity of the storage structure from the database.

13. A rendering apparatus comprising:

an active transceiver configured to energize a passive transceiver to generate a response signal; and a processor configured to:

monitor variation in a strength of the response signal; and determine, using the strength of the response signal, a pre-conditioning parameter indicative of a condition of the storage structure.

14. A print cartridge for a rendering apparatus, the print cartridge comprising a passive transceiver configured to generate a response signal when energized, wherein the passive transceiver is an RFID tag with an embedded antenna and identification number, and wherein the response signal generated has a strength on which basis a pre-condition parameter indicative of a condition of the rendering apparatus is determinable.

* * * * *